US006601946B1

(12) United States Patent
Wakahara et al.

(10) Patent No.: US 6,601,946 B1
(45) Date of Patent: Aug. 5, 2003

(54) IMAGE FORMING APPARATUS IN WHICH TONER IS REMOVED BY CHANGING ELECTRIC FIELD BETWEEN OPPOSING ELECTRODE AND CONTROL ELECTRODE

(75) Inventors: Shirou Wakahara, Chiba; Yukihito Nishio, Ikoma-gun; Yasuhiro Takai, Sakurai; Hirokazu Fujita, Nara, all of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/129,202

(22) Filed: Jul. 24, 1998

(30) Foreign Application Priority Data

Jul. 28, 1997 (JP) ..... 9-201181

(51) Int. Cl.[7] ..... B41J 2/06
(52) U.S. Cl. ..... 347/55
(58) Field of Search ..... 347/55, 151, 120, 347/141, 154, 103, 123, 111, 159, 127, 128, 131, 125, 158; 399/271, 290, 292, 293, 294, 295

(56) References Cited

U.S. PATENT DOCUMENTS 5,602,630 A * 2/1997 Endo et al. ..... 399/271
5,781,218 A * 7/1998 Wakahara et al. ..... 347/55
5,874,973 A * 2/1999 Wakahara ..... 347/55

FOREIGN PATENT DOCUMENTS

JP 4-286662 10/1992

* cited by examiner

*Primary Examiner*—John Barlow
*Assistant Examiner*—Raquel Yvette Gordon
(74) *Attorney, Agent, or Firm*—David G. Conlin; William J. Daley, Jr.; Edwards & Angell, LLP

(57) ABSTRACT

An image forming apparatus capable of forming an image with a uniform density includes a toner carrier, an opposing electrode, a high voltage power source for supplying a voltage to generate potential difference between the toner carrier and the opposing electrode, a control electrode arranged between the toner carrier and the opposing electrode and having a plurality of electrodes, and a control power source unit for implementing a plurality of potential states to each of the electrodes of the control electrode. The control electrode includes an insulating substrate, the plurality of electrodes provided on the insulating substrate and having passage portions for the toner, and a dielectric layer formed on a side facing the opposing electrode such that attracting force Fc attracting the toner adhered on the surface of the control electrode facing the opposing electrode is made smaller than attracting force Fb attracting the toner adhered on the opposing electrode. The control power supply unit includes an image forming unit for forming an image on a surface of a recording medium conveyed on the opposing electrode by applying prescribed potentials to respective ones of the plurality of electrodes and an electric field applying unit for applying an electric field of which electric field direction changes between the opposing electrode and the control electrode and which ensures that an electric force FE received by the toner adhered on the control electrode is greater than the attracting force Fc and that the force FE is smaller than the attracting force Fb.

9 Claims, 10 Drawing Sheets

IMAGE FORMING APPARATUS IN WHICH TONER IS REMOVED BY CHANGING ELECTRIC FIELD BETWEEN OPPOSING ELECTRODE AND CONTROL ELECTRODE

BACKGROUND OF THE INVENTION

1. Field of the Invention

The present invention relates to an image forming apparatus applied to a printing unit of a digital copying machine, a facsimile or the like as well as to a digital printer, a plotter or the like, for forming an image on a recording medium by jetting a developer.

2. Description of the Background Art

Recently, an image forming apparatus has been proposed which outputs image signals as a visible image on a recording medium such as a sheet of paper, as described, for example, in Japanese Patent Laying-Open No. 4-286662. In the apparatus, an electric field is exerted on charged particles so that the particles are jet out by electric force, and the charged particles reach and adhere to the recording medium, as a potential applied to a control electrode including a plurality of through holes arranged in the jet travel path is changed. In this manner, an image is directly formed on the recording medium. In addition, the control electrode is driven by a driver, and a developer removing electric field is formed in the through holes of the control electrode, whereby the developer left in the through holes of the control electrode is removed.

In the conventional image forming apparatus having the above described structure, means for controlling passage of charged particles through a gate is used. In such an image forming apparatus, whether charged particles (toner) are allowed to jet out or not is controlled by controlling an electric field generated between the gate and a tone carrier, and, by a strong electric field generated by an opposing electrode, the toner is attracted to reach the surface of the sheet, which is the recording medium.

In the above described image forming apparatus, the toner inevitably adheres on the control electrode. The toner adheres not only to the surface of the control electrode facing the carrier but also the inside of the gate through which toner passes and to that side of the control electrode which faces the opposing electrode. Adhesion of toner causes various problems.

For example, the potential to be applied to the control electrode is shielded by the toner. In addition, the potential of the control electrode varies because of the potential caused by the charges held by the toner. More specifically, the potential is changed to a state which does not allow jetting of toner, resulting in unsuccessful toner jetting. As jetting of the toner is not satisfactory, resulting dots may have their diameters varied, and density inappropriate, readily resulting in degraded image quality.

Further, in such a state, a desired electric field cannot be generated around the gate, and therefore the course of travel of the jetting toner considerably deviates from a satisfactory course, and therefore it becomes difficult to control the course of travel of the jetting toner. Under such condition, it is difficult to guide the toner to a prescribed position. As a result, scattering of the toner is apt to occur, degrading quality of resulting dots, and, as already mentioned above, the diameters and densities of the dots may vary.

In such a situation, image formation of desired halftone is difficult, and satisfactory color reproduction is difficult in a color image forming apparatus. Further, if adhesion of the toner to the control electrode takes place in the gate which is the passage for the toner, it hinders passage of the toner through the gate, so that a prescribed amount of toner cannot pass through the gate, resulting in the above described problems. Further, the course of travel of the jetting toner changes by contact between the passing toner and the toner adhered to the inside of the gate, or by an electric field generated by the charges held by the toner adhered inside the gate. Therefore, satisfactory control of the course of travel of the jetting toner becomes difficult as in the above, resulting in similar problems. In addition, excessive adhesion of the toner to the control electrode eventually causes clogging of the gate. This physically prevents passage of the toner, readily resulting in unsatisfactory image formation or blank.

If a portion of the sheet should contact the control electrode because of a wrinkle or curl of the sheet, the toner adhered on the control electrode on the opposing electrode side touches and stains the sheet. Further, it may tarnish the formed image.

Now that adhesion of the toner to the control electrode is unavoidable and the adhered toner causes various problems, it is necessary to clean the control electrode of the adhered toner. In the conventional image forming apparatus as represented by the one described above, an AC potential is applied to the control electrode to form a cleaning electric field, which is an AC electric field having a DC component between the control electrode and the opposing electrode or the carrier to remove the toner.

However, the toner contains not only the toner of a desired charge polarity but also toner having the charge polarity opposite to the desired polarity. It is possible by the method of cleaning toner represented by the above described prior art to remove the toner having a prescribed charge polarity (hereinafter referred to as positively charged toner). It is difficult, however, to remove the toner having charge polarity different from the positively charged toner (hereinafter referred to as negatively charged toner).

In order to remove the negatively charged toner, it is necessary to reverse the polarity of the DC component in the cleaning electric field, and, in that case, it becomes difficult to clean the positively charged toner. Accordingly, what is possible by the cleaning electric field is only to remove the toner of one polarity, and simultaneous cleaning of the toners having opposite polarities has been difficult. Therefore, toners of respective charge polarities have to be cleaned separately. If cleaning is done in an interval of paper feeding, the time required is twice as long as that necessary for cleaning toner having single polarity. This time requirement makes it difficult to shorten the interval between paper feeding, and hence hinders improvement in speed of printing.

SUMMARY OF THE INVENTION

The present invention was made to solve the above described problems, and its object is to provide an image forming apparatus capable of high speed printing.

Another object of the present invention is to provide an image forming apparatus capable of high speed printing ensuring highly effective cleaning and free of image degradation.

Another object of the present invention is to provide an image forming apparatus capable of high speed printing, reduction in number of parts, reduction in size and cost, and improvement in reliability.

The image forming apparatus in accordance with an aspect of the present invention includes a toner carrier for carrying toner, an opposing electrode arranged opposing to the toner carrier, a high voltage power source unit for supplying a voltage to generate potential difference between the toner carrier and the opposing electrode, a control electrode including a plurality of electrodes arranged between the toner carrier and the opposing electrode, and a control power source unit for implementing a plurality of potential states of respective electrodes of the control electrode, the control electrode including an insulating substrate, the aforementioned plurality of electrodes each having a passage portion for the toner provided on the insulating substrate, and a dielectric layer formed on the side of the opposing electrode such that attracting force Fc exerted on the toner adhered on that surface of the control electrode which faces the opposing electrode is made smaller than attracting force Fb exerted on the toner adhered on the opposing electrode, and the control power source unit including an image forming unit for applying prescribed potentials to respective ones of the plurality of electrodes to control passage of the toner through the passage portion for forming an image on a surface of a recording medium conveyed over the opposing electrode, and an electric field applying unit for applying an electric field of which electric field direction changes between the opposing electrode and the control electrode and which ensures that electric force FE exerted on the toner adhered on the control electrode is greater than the attracting force Fc and that the electric force FE is smaller than the attracting force Fb.

When the toner reciprocates between the opposing electrode and the control electrode, the toner on the control electrode moves to the surface of the opposing electrode and eventually the control electrode is clean of the toner, as the toner moves to the opposing electrode because of difference in attracting force. In such a structure, cleaning of toner is possible regardless of the polarity of the toner. Therefore, there is not at all the influence of the negatively charged toner, and the control electrode can be cleaned by a single cleaning operation. Accordingly, it becomes unnecessary to repeat the cleaning operation for toners of different polarities to be cleaned. This means that the interval between paper feeding can be reduced and that the speed of printing is improved.

Preferably, the electric field applying unit includes a rectangular wave potential applying circuit for applying a rectangular wave potential to generate an electric field which ensures that the electric force FE received by the toner adhered on the control electrode is higher than the attracting force Fc and that the electric force FE is lower than the attracting force Fb.

When the rectangular wave potential is applied, the direction of the electric field changes in a moment, causing a significant amount of change in the electric field. This provides the same effect as caused by oscillation over extremely wide frequency range, further enhancing the effect of cleaning. As the effect of cleaning is enhanced, degradation in image quality is better suppressed.

More preferably, the rectangular wave potential applying circuit includes a circuit for applying the rectangular wave potential to generate an electric field not having any DC component which ensures that the electric force FE received by the toner adhered on the control electrode is greater than the attracting force Fc and that the electric force FE is smaller than the attracting force Fb.

Since the electric field does not have any DC component, both the positively charged toner and negatively charged toner can equally be removed, enabling effective cleaning. Accordingly, degradation of image quality is prevented.

More preferably, the toner, the toner carrier, the opposing electrode and the control electrode include a plurality of different toners, a plurality of toner carriers, a plurality of opposing electrodes and a plurality of control electrodes, respectively. The electric field applying unit includes circuits for applying a plurality of electric fields in accordance with respective characteristics of the plurality of different toners, the direction of which electric fields change respectively between the plurality of opposing electrodes and the plurality of control electrodes and which ensure that a plurality of electric forces FFE received by the plurality of different toners adhered on the plurality of control electrodes are greater than the attracting forces FFc of the plurality of different toners adhered on that surface of the plurality of control electrodes facing the opposing electrodes, and that the plurality of electric forces FFE are smaller than the attracting forces FFb of the plurality of different toners adhered on the plurality of opposing electrodes, respectively.

The electric field is changed in accordance with the characteristic of the toner used. This ensures effective cleaning and prevents degradation of image quality.

More preferably, the toner, the toner carrier, the opposing electrode and the control electrode include a plurality of different toners, a plurality of toner carriers, a plurality of opposing electrodes and a plurality of control electrodes, respectively. The electric field applying unit includes a circuit for applying a single electric field satisfying a prescribed condition, the dielectric layer of each of the plurality of control electrodes includes a dielectric layer having a dielectric constant or thickness adjusted to satisfy the prescribed condition when the single electric field is applied by the electric field applying unit, each of the plurality of different toners includes a toner having its charge amount adjusted to satisfy the prescribed condition when the single electric field is applied by the electric field applying unit, and the prescribed condition is as follows. The direction of the electric field changes between the plurality of opposing electrodes and the plurality of control electrodes, respectively, a plurality of electric forces FFE received by the plurality of different toners adhered on plurality of control electrodes respectively are greater than attracting forces FFc of the plurality of different toners adhered on that surface of the plurality of control electrodes that faces the opposing electrodes, and that the plurality of electric forces FFE are smaller than attracting forces FFb of the plurality of different toners adhered on the plurality of opposing electrodes.

The characteristic of the control electrode or the toner is adjusted to enable cleaning of all control electrodes by a single electric field. Accordingly, it becomes unnecessary to provide a plurality of power sources for cleaning respective control electrodes. This enables reduction in the number of parts, size, cost and improves reliability.

More preferably, the image forming apparatus further includes a cleaning unit for removing the toner adhered on the surface of the opposing electrode.

It is possible to clean the toner which has moved from the control electrode to the opposing electrode. Therefore, an image forming apparatus is provided in which staining of a rear surface of the sheet by the toner adhered on the surface of the opposing electrode is prevented.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

The image forming apparatus in accordance with the embodiments of the present invention will be described with reference to the figures. In the following, an image forming apparatus having a configuration corresponding to a negatively charged toner will be described in detail. When a positively charged toner is used, polarities of respective applied voltages may be set accordingly.

Figure 1:
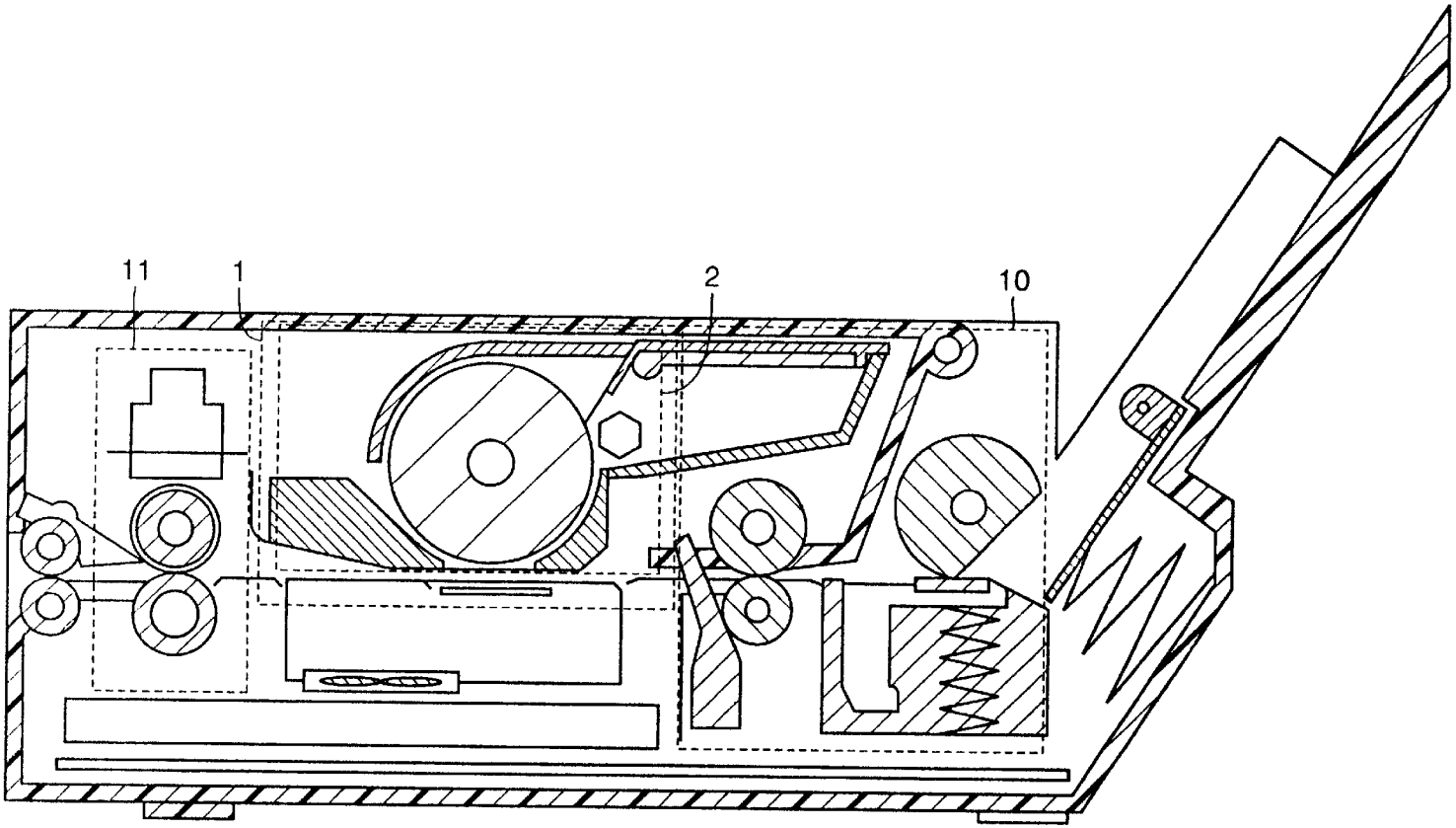
FIG. 1 is a cross section of the image forming apparatus in accordance with the present invention.

Referring to FIG. 1, the image forming apparatus includes a paper feeder 10 for feeding sheets of paper, an image forming unit 1 for forming an image on the fed sheet of paper, and a fixing unit 11 for fixing on the sheet the toner image formed on the sheet at the image forming unit 1 by heating and pressurizing.

Figure 2:
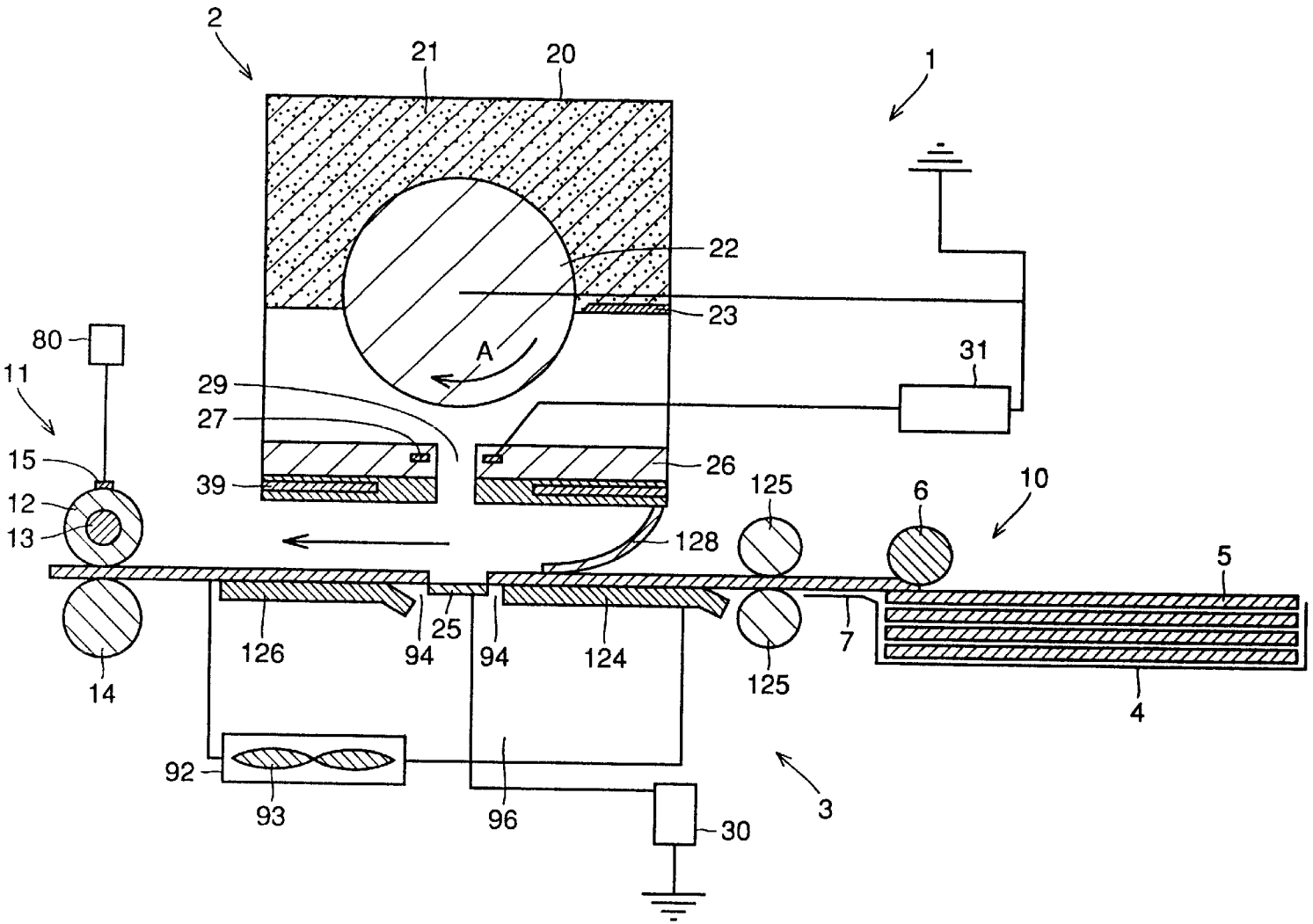
FIG. 2 is a schematic cross section showing a main portion of the image forming apparatus in accordance with the present invention.

Referring to FIG. 2, image forming unit 1 includes a toner supply unit 2 and a printing unit 3. The image forming unit 1 is for developing an image corresponding to image signals on a sheet of paper as a recording medium, using a toner as a developer. More specifically, in the image forming apparatus, the toner is jetted and adhered to the sheet, and the jetting of the toner is controlled by the image signals, so that the image is directly formed on the sheet.

At the paper feeding side to the image forming unit 1, paper feeder 10 is provided. Paper feeder 10 includes a sheet cassette 4 containing sheets 5 of paper as recording medium, a pickup roller 6 for picking up and feeding out a sheet 5 from sheet cassette 4, and a pair of resist rollers 125 for providing a prescribed speed of conveying to a paper feed guide 7 guiding the supplied sheet 5 as well as to the sheet 5.

The paper feeder 10 further includes a paper feed sensor (not shown) detecting feeding of sheet 5. Pickup roller 6 is driven to rotate by a driving apparatus, not shown.

Fixing unit 11 includes a heating roller 12, a pressurizing roller 14 arranged to pinch sheet 5 together with heating roller 12, a heater 13 provided in heating roller 12, a temperature sensor 15 arranged to be in contact with the surface of heating roller 12, and a temperature control circuit 80 connected to temperature sensor 15.

Heating roller 12 is formed of an aluminum tube having a thickness of 2 mm, for example. Heater 13 is a halogen lamp, for example, and contained in heating roller 12. Pressurizing roller 14 is formed, for example, of silicone resin.

A load of 2 kg, for example, is applied by means of a spring or the like to opposing ends of respective shafts of heating roller 12 and pressurizing roller 14 so as to enable pinching and pressurizing of sheet 5.

Temperature sensor 15 measures surface temperature of heating roller 12. Temperature control circuit 80 is controlled by a main controlling unit (not shown), and it controls turning ON/OFF of heater 13 based on the result of measurement by temperature sensor 15, so that the surface temperature of heating roller 12 is maintained at 150° C., for example. Fixing unit 11 includes a paper discharge sensor (not shown) for detecting discharge of sheet 5.

Materials of heating roller 12, heater 13, pressurizing roller 14 and so on are not specifically limited. Further, the surface temperature of heating roller 12 is not specifically limited. Fixing unit 11 may have a structure for fixing toner image by heating or pressurizing the sheet 5.

Though not shown, on the sheet discharging side of fixing unit 11, there are a paper discharge roller for discharging sheet 5 received by fixing unit 11 onto a paper discharge tray, and a paper discharge tray receiving the discharged sheet 5. Heating roller 12, pressurizing roller 14 and the discharge roller are driven to rotate by a driving apparatus, not shown.

Toner supplying unit 2 of image forming unit 1 includes a toner tank 20 containing a toner 21 as a developer, a toner carrier 22 which is a cylindrical carrier (sleeve) carrying toner 21 by magnetic force, and a doctor blade 23 provided in toner tank 20 for charging toner 21 and regulating thickness of a toner layer carried on an outer peripheral surface of toner carrier 22. Doctor blade 23 is provided on an upstream side in the direction of rotation of toner carrier 22 such that a distance from the outer peripheral surface of toner carrier 22 is 60 $\mu$m, for example. Toner 21 is a magnetic toner, for example, and is charged with negative charges by doctor blade 23.

The distance between doctor blade 23 and toner carrier 22 is not specifically limited.

Toner carrier 22 is driven by a driving apparatus, not shown, and rotates at a speed on its surface of 80 mm/sec, for example, in the direction of an arrow A in the figure. Toner carrier 22 is grounded, and inside toner carrier 22, there are magnets, not shown, fixed at a position opposing to doctor blade 23 and at a position opposing to a control electrode 26, which will be described later, respectively. Each of the magnets has at least two polarities. Accordingly, toner carrier 22 is able to carry toner 21 on its outer peripheral surface. The toner 21 carried on the outer peripheral surface of toner carrier 22 provides magnetic brush at positions on the outer peripheral surface corresponding to the aforementioned positions.

The speed of rotation of toner carrier 22 is not limited to that mentioned above. Toner carrier 22 may carry toner 21 not by magnetic force but by electric force or by electric and magnetic forces.

Printing unit 3 of image forming unit 1 includes: an opposing electrode 25 formed of an aluminum plate of 1 mm, for example, opposing to the outer peripheral surface of toner carrier 22; a high voltage power source 30 supplying a high voltage to the opposing electrode 25; a cleaning brush 25*b* (which will be described with reference to FIG. 15) for removing the developer adhered on the surface of opposing electrode 25; a driving unit 25*c* (which will be described with reference to FIG. 15) for cleaning brush 25*b*; a control electrode 26 provided midway to toner carrier 22; paper guides 124, 126 and 128; and a suction apparatus 92 for attracting by air sheet 5 so that the sheet is not brought into contact with control electrode Suction apparatus 92 includes a fan 93 for reducing pressure in a chamber 96, an air inlet 94 for attracting by suction the sheet 5, and the opposing electrode 25.

The opposing electrode is provided at a distance of 1 mm from the outer peripheral surface of toner carrier 22, for example. Suction apparatus 92 reduces pressure in chamber 96 by means of fan 93, so as to attract by air the sheet 5 onto air inlet 94, by the reduced pressure.

A high voltage of 2 kV is applied, for example at the time of printing, by high voltage power source 30 to opposing electrode 25. More specifically, between opposing electrode 25 and toner carrier 22, an electric field necessary for jetting toner 21 carried on toner carrier 22 to the direction of opposing electrode 25 is generated by the high voltage applied from high voltage power source 30.

The distance between opposing electrode 25 and toner carrier 22 is not specifically limited. Further, the voltage applied to opposing electrode 25 is not specifically limited.

Though not shown, the image forming apparatus includes, as control circuitry, a main control unit for controlling the overall image forming apparatus, an image processing unit for converting obtained image data to the format of image data to be printed, an image memory for storing converted image data, and an image formation control unit for converting the image data obtained from the image processing unit to image data to be applied to control electrode 26.

The control electrode 26 is parallel to opposing electrode 25 and extends two dimensionally, opposing to opposing electrode 25. Control electrode 26 has such a structure that allows passage of the toner from toner carrier 22 to the direction of opposing electrode 25. By a potential applied to control electrode 26, the electric field near the surface of toner carrier 22 changes, whereby jetting of toner 21 from toner carrier 22 to opposing electrode 25 is controlled.

Control electrode 26 is provided at a distance of 100 $\mu$m for example, from the outer peripheral surface of toner carrier 22, and fixed by a support member, not shown.

Figure 3:
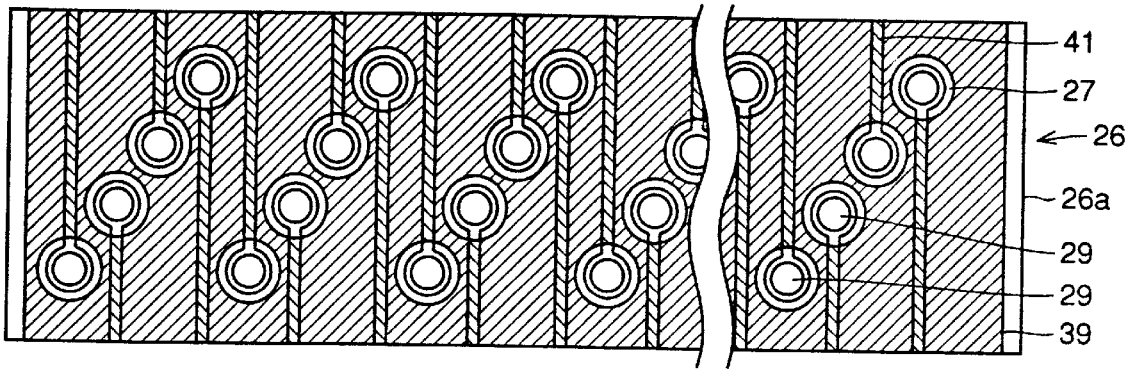
FIG. 3 is a plan view showing a control electrode of the image forming apparatus in accordance with the present invention.

Referring to FIG. 3, control electrode 26 includes an insulating substrate 26*a*, a high voltage driver (not shown) and mutually independent ring-shaped conductors, that is, ring-shaped electrodes 27. Insulating substrate 26*a* is formed of polyimide resin, for example, to have a thickness of 25 $\mu$m. Insulating substrate 26*a* is provided with holes which will be gates 29, described later. Ring-shaped electrodes 27 are each formed of a copper foil having the thickness of 18 $\mu$m around its hole, and provided in accordance with a prescribed arrangement. Opening of each hole is formed to have a diameter of 160 $\mu$m, for example, and it serves as a passage portion of toner 21 jetting from toner carrier 22 to opposing electrode 25. This passage portion will be referred to as gate 29 in the following.

Further, on that side of control electrode 26 which faces opposing electrode 25, there is arranged a shield electrode 39 which is formed of one electrode and is grounded.

The distance between control electrode 26 and toner carrier 22 is not specifically limited. Each ring-shaped electrode 27 has an opening having the diameter of 200 $\mu$m.

The size of gate 29, as well as materials and thicknesses of insulating substrate 26*a* and ring-shaped electrodes 27 are not specifically limited.

Ring-shaped electrodes 27 are electrically connected to control power supply unit 31 through power supply line 41 and a high voltage driver (not shown). The number of ring-shaped electrodes 27 is not specifically limited.

Figure 14:
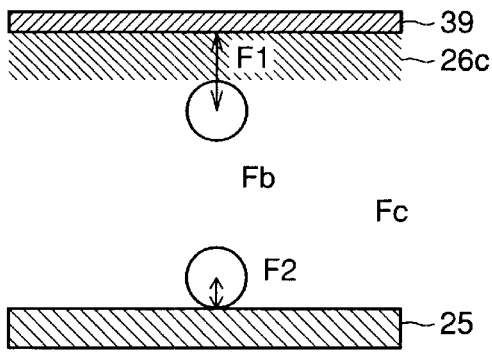
FIG. 14 is an illustration representing attracting force of the developer.

Further, the surface of ring-shaped electrodes 27, the surface of power supply line 41 and the surface of shield electrode 39 are covered by a protective layer 26*c* (which will be described with reference to FIG. 14), which is an insulator having the thickness of 30 $\mu$m. This ensures insulation of ring-shaped electrodes 27 from each other, insulation of power supply lines 41 from each other, insulation between ring-shaped electrodes 27 and power supply lines 41 not connected to each other, and insulation between control electrode 26 and toner carrier 22 or opposing electrode 25.

To each ring-shaped electrode 27 of control electrode 26, a pulse in accordance with the image signal, that is, a voltage, is applied by control power supply unit 31. More specifically, control power supply unit 31 applies to ring-shaped electrode 27 a voltage of 350 V (hereinafter referred to as ON potential), for example, when toner 21 carried on toner carrier 22 is to be passed to opposing electrode 25, and applies a voltage of 0 V (hereinafter, OFF potential), for example, if the toner is not to be passed.

When sheet 5 is arranged on that side of opposing electrode 25 which faces toner carrier 22 and a potential applied to control electrode 26 is controlled in accordance with image signal as described above, a toner image in accordance with the image signal is formed on the surface of sheet 5.

Control power source unit 31 is controlled by a control electrode control signal applied from the image formation control unit, not shown.

Figure 4:
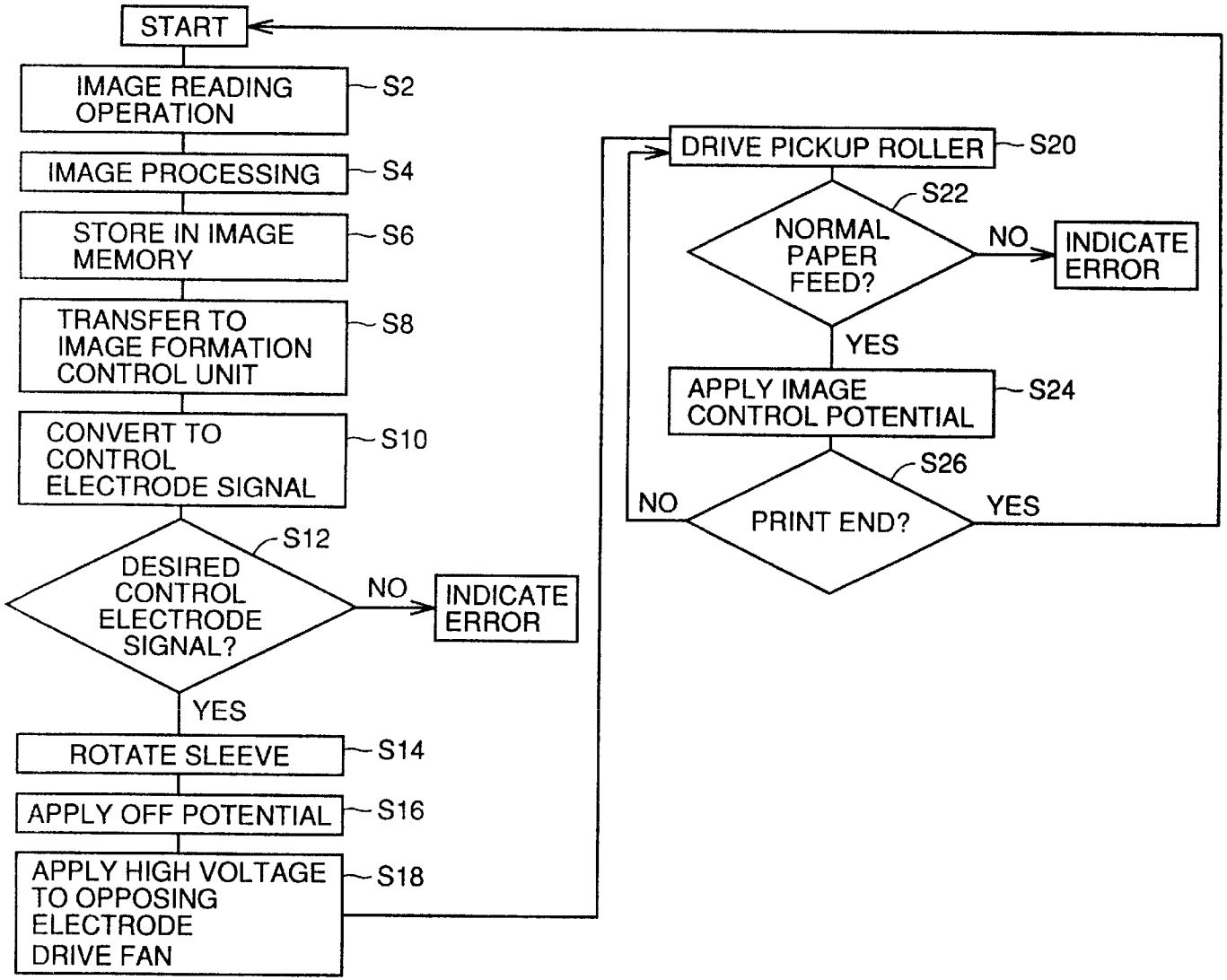
FIG. 4 is a flow chart showing a printing operation of the image forming apparatus in accordance with the present invention.

The image forming apparatus may be used as a printer as an output apparatus for a computer or a word processor, and in addition, it may be used at a printing unit of a digital copying machine. In the following, an operation of image formation when the apparatus is used as a printing unit of the digital copying machine will be described with reference to FIG. 4.

First, an original to be copied is placed at an image reading unit, for example, and when a copy start button (not shown) is operated, the main control unit, receiving the input, starts the image forming operation. More specifically, the original image is read by the image reading unit (S2). The image data is processed by the image processing unit (S4) and stored in the image memory (S6). The image data stored in the image memory is transferred to the image formation control unit (S8). The image formation control unit starts converting the input image data to control electrode control signal to be applied to control electrode 26 (S10).

Toner carrier 22 rotates (S14), and OFF potential is applied to toner 21 (S16). Thereafter, a high voltage is applied to opposing electrode 25 and fan 93 is driven (S18). When a prescribed amount of the control electrode control signals are obtained in the image formation control unit (YES in S12), the driving apparatus, not shown, operates, and by pickup roller 6 shown in FIG. 2 which is driven to rotate by the driving apparatus feeds sheet 5 in sheet cassette 4 to image forming unit 1 (S20). At this time, the paper feed sensor detects that the paper feeding is in a normal state (YES in S22). The sheet 5 fed by pickup roller 6 is pushed out at a prescribed speed by resist roller 125. Thereafter, the sheet 5 reaches air inlet 94, and conveyed in the attracted state, to an area where opposing electrode 25 opposes to control electrode 26. In this state, sheet 5 moves at a prescribed speed, sliding over paper guides 124 and 126. The aforementioned prescribed amount of the control electrode control signals depends on configuration or the like of the image forming apparatus.

Thereafter, the image formation control unit supplies the control electrode control signals to control power supply unit 31 (S24). Based on the control electrode control signals, control power supply unit 31 controls voltages to be applied to each of the ring-shaped electrodes 27 of control electrode 26. More specifically, the potential of 350 V or 0 V is applied to prescribed ones of the ring-shaped electrodes 27 from control power supply unit 31, so that the electric field near control electrode 26 is controlled. More specifically, at gate 29 of control electrode 26, whether jetting of toner 21 from toner carrier 22 to opposing electrode 25 is allowed or prevented is appropriately controlled in accordance with the image data. In this manner, a toner image in accordance with the image signals is formed on sheet 5 which is moving to the discharging side over the surfaces of paper guides 124 and 126.

Sheet 5 on which the toner image has been formed is fed to fixing unit 11, and at the fixing unit 11, the toner image is fixed on the sheet 5. The sheet 5 on which the toner image has been fixed is discharged to the discharge tray by the discharge roller, and the paper discharge sensor detects normal discharge. Based on this detection, the main control unit determines that the printing operation is terminated successfully (YES in S26).

By the above described image forming operation, a good image is formed on the sheet 5. In the image forming apparatus of the present invention, the image is directly formed on sheet 5. Therefore, a photoreceptor or a developer body such as a dielectric drum, which has been used in the conventional image forming apparatus, is unnecessary. Accordingly, a transfer operation for transferring the image from the developing body to sheet 5 is eliminated, and hence degradation of image quality caused in this operation is prevented. Thus, reliability of the apparatus is improved. Further, the structure of the apparatus is simplified, and the number of parts is reduced, enabling reduction in size and cost.

No matter whether the image forming apparatus in accordance with the present embodiment is used as a printing unit of an output terminal of a computer or as a printing unit of a digital copying machine, the method of image formation itself is the same, though image signals to be processed and exchanged may be different.

The potential applied to the ring-shaped electrode 27 of control electrode 26 for preventing passage of toner 21 and the potential applied to allow passage of toner 21 through ring-shaped electrode 27 are not specifically limited.

An operation of cleaning control electrode 26 in the above described embodiment is as follows.

Figure 5:
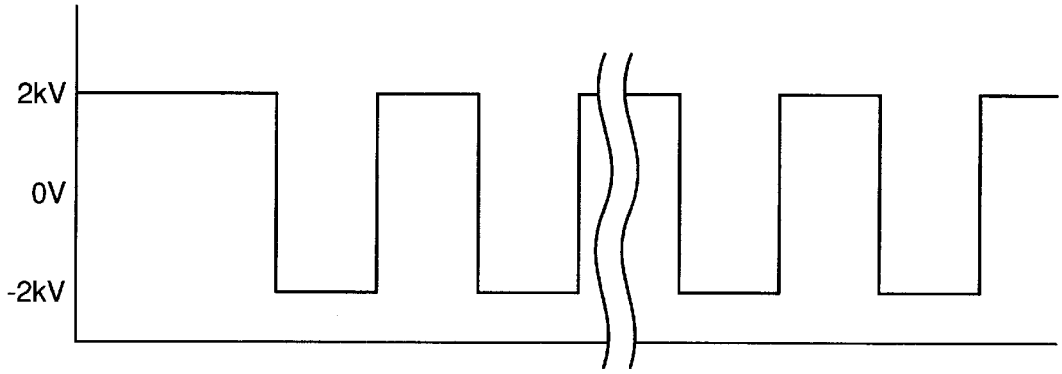
FIG. 5 is an illustration showing an example of cleaning potential applied to the opposing electrode in the image forming apparatus of the present invention.
Figure 6:
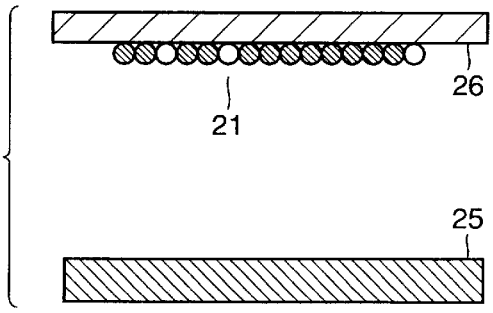
FIGS. 6 to 13 are first to eighth illustrations showing behavior of the developer caused by the cleaning electric field.

When control electrode 26 is cleaned, an oscillation potential, one example of which is shown in FIG. 5, is applied to opposing electrode 25. Referring to FIG. 5, in an interval of sheet feeding in continuous printing, a rectangular wave having the frequency of 50 Hz, amplitude of 2 kV and a duty factor of 50% is applied as a cleaning potential, and a cleaning electric field is formed. The behavior of toner 21 adhered on control electrode 26 under such condition is schematically shown in FIGS. 6 to 13.

Toner 21 adhered on control electrode 26, is at first, adhered on that surface of control electrode 26 which faces opposing electrode 25.

In FIGS. 6 to 13, hatched circles represent positively charged toner particles 21, while white circles represent negatively charged toner particles 21.

Figure 7:
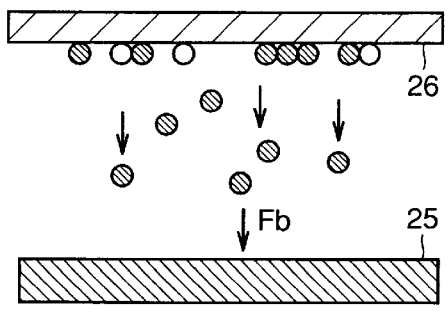

In this state, when such a cleaning potential as shown in FIG. 5 is applied and a cleaning electric field is generated, toner particles 21 adhered on control electrode 26 are oscillated. Accordingly, attracting force such as van der Waals force attracting the toner particles to control electrode 26 is reduced, and among the toner particles 21, those which are weakly attracted to opposing electrode 25 start jetting out from control electrode 26, as shown in FIG. 7. FIG. 7 shows a state where the same electric field as applied at the time of printing is applied.

Figure 8:
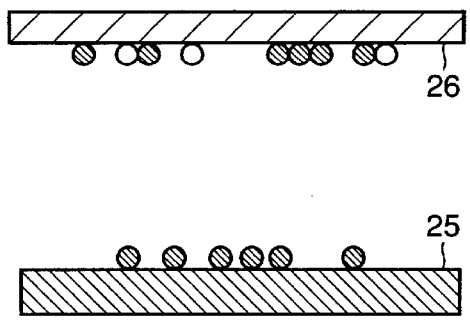

The toner particles jetted as shown in FIG. 7 reach opposing electrode 25 as shown in FIG. 8. Thereafter, when an electric field opposite in direction to that at the time of printing is applied, some toner particles return from opposing electrode 25 to control electrode 26, while some negatively charged toner particles newly start jetting out because of the electric field, as shown in FIG. 9.

Figure 9:
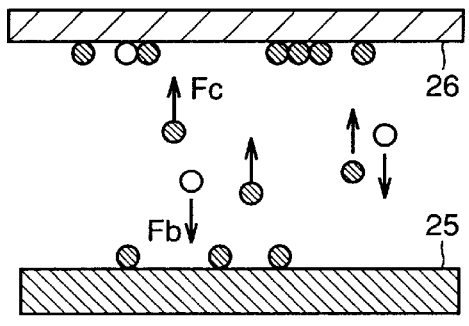

Here, among the toner particles which have reached opposing electrode 25 as shown in FIG. 8, some start jetting toward control electrode 26, while others remain on the surface of opposing electrode 25, as shown in FIG. 9.

When such a potential as shown in FIG. 5 is applied, the electric fields generated in the states of FIGS. 7 and 9 come to have opposite directions and equal electric field strength. Therefore, it may be considered that the amount of toner particles jetting in the states of FIGS. 7 and 9 are same in amount. More specifically, the amount of toner particles jetting out from control electrode 26 to opposing electrode 25 should be the same as the amount of toner particles jetting out from opposing electrode 25 to control electrode 26. Actually, however, the amount of toner particles traveling toward control electrode 26 is smaller than toner particles jetting out to opposing electrode 25, from the following reason.

Attracting force Fc attracting toner 21 to control electrode 26 is compared with attracting force Fb attracting tone 21 to opposing electrode 25. When toner 21 is oscillated and attracting force is reduced as in the present embodiment, an image force is of critical importance. Therefore, image force F1 at the surface of control electrode 26 and image force F2 at the surface of opposing electrode 25 shown in FIG. 14 will be compared. Image force F1 is acting on shield electrode 39 through protective layer 26*c*, which is a dielectric body, while image force F2 acts with the toner 21 existing on a metal surface. Considering the fact that the image force is in reverse proportion to a square of twice the distance between a charge and the metal, there is a relation of $F1 \ll F2$. Accordingly, it can be readily understood that $Fc \ll Fb$.

Therefore, even when an electric field having opposite direction to that of FIG. 7 is applied as shown in FIG. 8, the amount of toner particles returning from opposing electrode 25 to control electrode 26 is not the same as the amount jetting from control electrode 26 to opposing electrode 25, provided that the electric field has its electric force FE adjusted to satisfy the relation $Fc<FE<Fb$. In other words, though some of the particles return to control electrode 26, others remain on the opposing electrode 25, as these charges cannot jet out because of the image force, as shown in FIG. 9.

Figure 10:
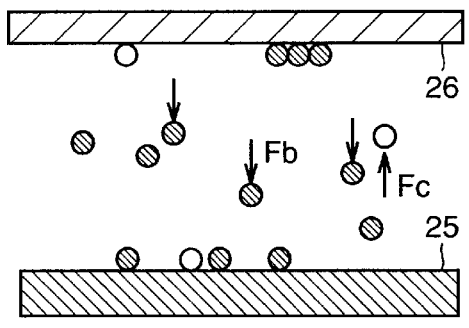
Figure 11:
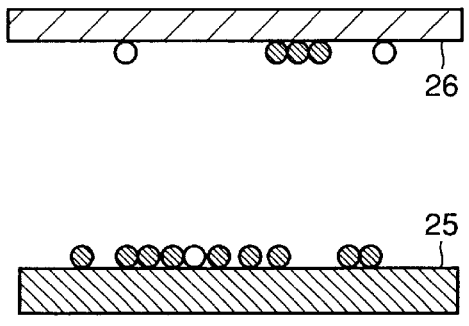
Figure 12:
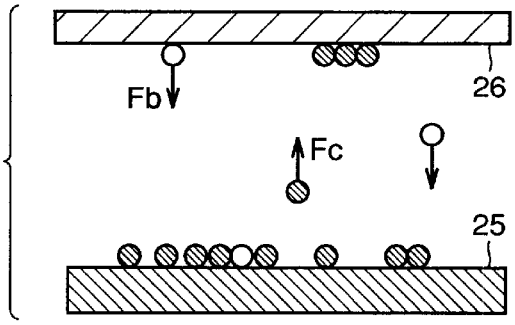
Figure 13:
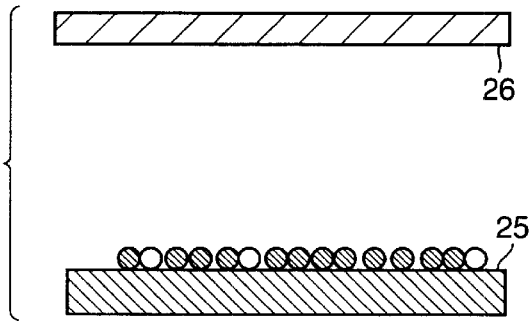

Further, a phenomenon is observed where toner particles 21 returning from opposing electrode 25 to control electrode 26 collide toner particles 21 remaining on control electrode 26, and when the same electric field as applied in the state of FIG. 7 is again applied as shown in FIG. 10, toner particles 21 which did not move in the state of FIG. 7 start jetting or movement. Such behavior is similarly observed no matter the particles are positively charged toner particles 21 or negatively charged toner particles 21. Such operation is repeated as shown in FIGS. 11 and 12 and, finally, toner particles 21 which have been adhered on control electrode 26 are all moved to opposing electrode 25 as shown in FIG. 13. Thus control electrode 26 is cleaned.

In this manner, in the present embodiment, it is possible to clean not only toner particles 21 of a single polarity but both positively charged and negatively charged toner particles 21, by a single cleaning operation. Therefore, the problem of long time required for cleaning in the interval of paper feeding can be avoided, and hence speed of printing can be improved.

Figure 15:
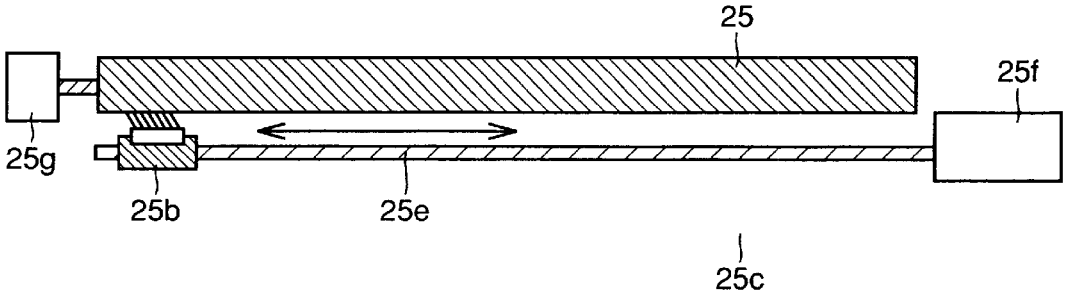
FIG. 15 is an illustration showing the method of cleaning the opposing electrode.

Further, in the present embodiment, control electrode 26 is cleaned by moving toner particles 21 adhered on control electrode 26 to opposing electrode 25. Therefore, it is preferable to separately provide means for cleaning opposing electrode 25. Referring to FIG. 15, in the present embodiment, a cleaning brush 25*b* as means for cleaning opposing electrode 25, and a driving unit 25*c* for the cleaning brush 25*b* are provided. Opposing electrode 25 is driven to rotate by driving unit 25*c*.

Further, driving unit 25*c* is movable in the direction of the arrow in the figure by the rotation of a motor 25*f* which drives and rotates a shaft 25*e* having a threaded groove. Further, opposing electrode 25 has a driving unit 25*g* for allowing prescribed rotation. In order to enable satisfactory printing and satisfactory cleaning of opposing electrode 25 at prescribed timings, opposing electrode 25 is driven to rotate.

In this structure, opposing electrode 25 is rotated before or after cleaning of control electrode 26 in the interval of paper feeding, for example. A planar surface of opposing electrode 25 facing cleaning brush 25*b* is cleaned by brush 25*b* moved by driving unit 25*c*. The opposing electrode 25 is controlled and driven such that the cleaning surface opposes to control electrode 26 prior to feeding of sheet 5.

Though opposing electrode 25 has a plate shape in the present embodiment, the shape is not limited thereto. Any shape ensuring satisfactory printing and satisfactory cleaning may be used, and it may have a polygonal cross section, for example.

As opposing electrode 25 is cleaned in this manner, the toner particles adhered on opposing electrode 25 never adheres to a rear surface of the fed sheet 5, and therefore, staining of the rear surface of sheet 5 is prevented.

Though opposing electrode 25 has a metal surface in the present embodiment, it is not limited thereto provided that the above described cleaning is possible. For example, it is possible to arrange a dielectric body on the surface of opposing electrode 25. For example, a dielectric layer formed of PVDF (polyvinylidene fluoride) may be arranged on the surface of opposing electrode 25. PVDF has as high a relative dielectric constant as about 8 to 15, and hence it well satisfies the relation of F1<<F2 of the image force for the cleaning described above.

Here, if the dielectric layer has high resistance value, it would be difficult to neutralize or eliminate friction charges caused by friction with sheet 5 or cleaning brush 25*b*. Therefore, a material having the resistance value within a certain range, for example, about $1.0\times10^{5}$ to $10^{14}\Omega\cdot$cm may be used as the dielectric body, and more preferably, the dielectric body having the resistance value of $1.0\times10^{10}$ $\Omega\cdot$cm may be used.

Figure 16:
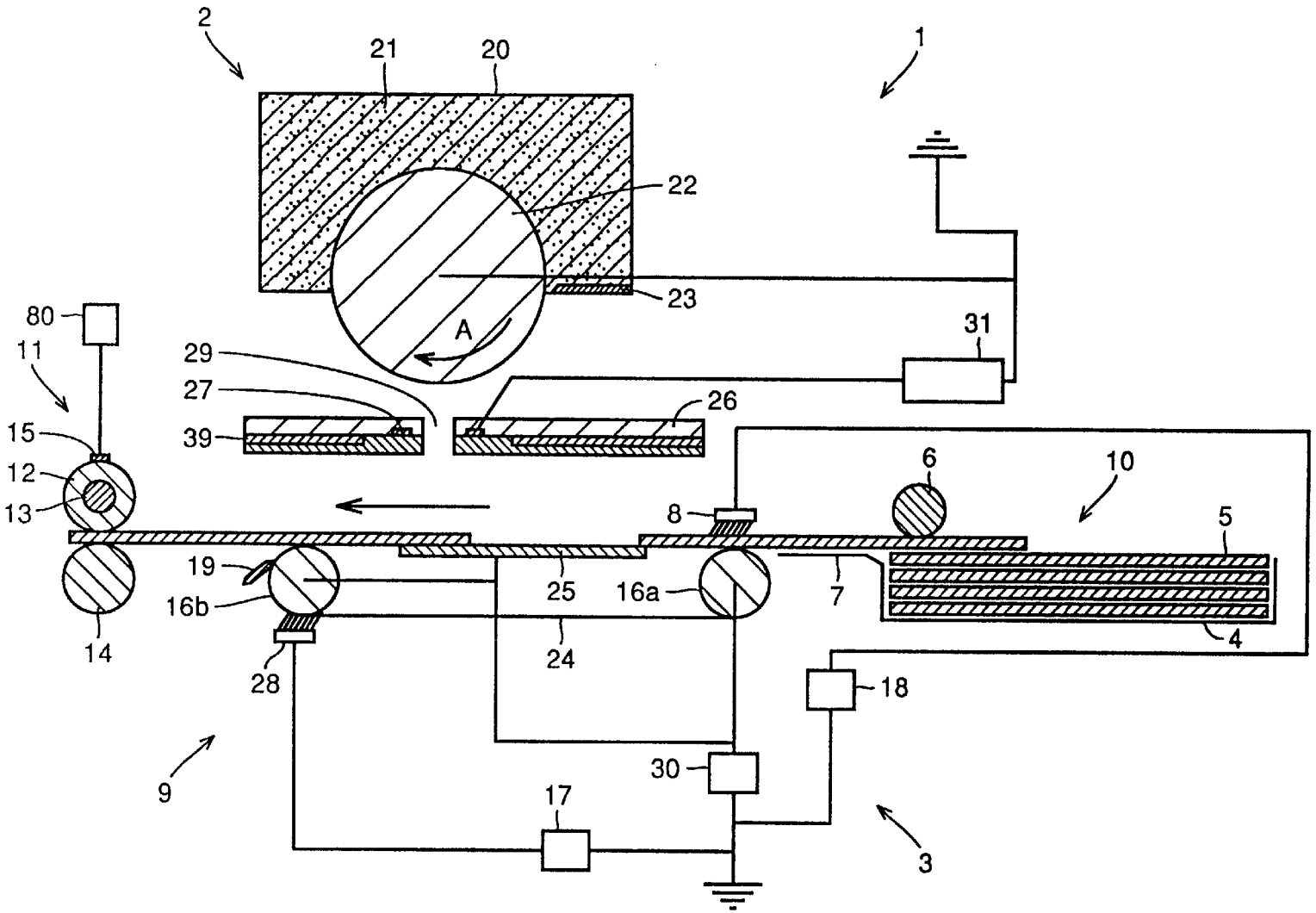
FIG. 16 is a cross section showing another embodiment of the image forming apparatus in accordance with the present invention.

Utilizing the structure in which a dielectric body is arranged on the surface of opposing electrode 25, a structure such as shown in FIG. 16 of the image forming apparatus is possible. Referring to FIG. 16, in place of suction apparatus 92 in the image forming apparatus shown in FIG. 2, an electrostatic attracting apparatus 9 is arranged for attracting and feeding sheet 5.

Electrostatic attracting apparatus 9 includes a dielectric belt 24, support members 16*a* and 16*b* supporting dielectric belt 24, a cleaner blade 19 as means for cleaning the surface of dielectric belt 24, a discharging brush 28 for discharging the surface of dielectric belt 24, and a charging brush 8. Opposing electrode 25 is provided such that the distance from the outer peripheral surface of toner carrier 22 is 1.1 mm, for example. Dielectric belt 24 is formed using PVDF as a base material, and it has volume resistivity of $10^{10}$ $\Omega\cdot$cm and the thickness of 75 $\mu$m . Dielectric belt 24 is driven by a driving apparatus, not shown, and rotates with the speed at its surface of 30 mm/sec, in the direction of the arrow shown in the figure.

A high voltage of 2.3 kV, for example is applied by high voltage power source 30 to opposing electrode 25. More specifically, between opposing electrode 25 and toner carrier 22, an electric field necessary for causing toner 21 carried on toner carrier 22 to travel toward opposing electrode 25 is generated by the high voltage applied from high voltage power source 30.

The discharging brush 28 is provided to be in pressure contact with dielectric belt 24, on downstream side of control electrode 26 in the direction of rotation of dielectric belt 24. A discharging potential of 2.5 kV is applied from a discharging power source 17 to discharging brush 28, and unnecessary charges existing on the surface of dielectric belt 24 are removed.

Cleaning blade 19 is to prevent contamination of the rear surface of sheet 5 by toner 21, by removing toner 21 when toner 21 accidentally adheres to dielectric belt 24 or toner 21 which has been removed from control electrode 26 at the time of cleaning of the control electrode 26 accidentally adheres, such as in the case of paper jamming, for example.

Charging brush 8 is provided to be in pressure contact with dielectric belt 24 at a position opposing to support member 16*a* on an upstream side of control electrode 26 in the direction of rotation of dielectric belt 24. As described above, a high voltage of 2.3 kV is applied to opposing electrode 25 and support member 16*a*, and a high voltage of 1.2 kV is applied to charging brush 8 by charging power source 18. Because of potential difference between charging brush 8 and support member 16*a*, negative charges are supplied to the surface of sheet 5 conveyed between charging brush 8 and dielectric belt 24. By the thus supplied negative charges, sheet 5 is kept attracted on dielectric belt 24, and is moved immediately below gate 29 as dielectric belt 24 moves, because of the electrostatic force. Charges on the surface of dielectric belt 24 attenuate with time until the belt reaches immediately below gate 29, and because of the influence of the potential of opposing electrode 25, the surface potential attains to 2 kV. In this manner, it is possible to convey sheet 5 by electrostatic attraction, and to form an image by causing jetting of toner 21 in a desired manner. Other components may be the same as those shown in FIG. 2, and therefore description thereof is not repeated.

In the above described embodiment, the potential applied to opposing electrode 25 is an oscillating electric field not having any DC component as shown in FIG. 5, and the electric field formed between control electrode 26 and opposing electrode 25 is also an oscillating electric field not having any DC component. Further, in the above described embodiment, electric field strength of the electric field formed by the oscillating component is made equal in the direction of toner 21 toward opposing electrode 25 and toward control electrode 26. Accordingly, the cleaning operation is performed in completely the same manner both for the positively charged toner particles and negatively charged toner particles 21 as described above, and hence control electrode 26 can be cleaned satisfactory regardless of the charge polarity of toner 21.

When the oscillation electric field generated in the above described structure, however, has a DC component, cleaning of toner 21 having the polarity corresponding to the DC component would be more effective, while cleaning of toner 21 having opposite polarity would be less satisfactory.

However, control is not limited to the example not having any DC component, and control with DC component may be acceptable, if good cleaning is possible.

By contrast, if the amount of charges of toner 21 of one polarity is very large or small, it is possible to appropriately adjust the DC component corresponding to this imbalance, so as to enable more effective cleaning operation.

In commonly used toner, not so significant difference is generated in characteristic values between positively charged toner and negatively charged toner. Therefore, most satisfactory cleaning is done when the oscillating electric field not having any DC component is used.

Though shield electrode 39 arranged on control electrode 26 is grounded in the above described embodiment, it may not be grounded, and a potential of about 50 V may be applied. In that case, even when the above described cleaning potential is applied, the generated oscillating electric field comes to have only a small DC component. For example, it may have a DC component of 50 V as compared with the oscillating component of 2 kV. Therefore, almost the same effect of cleaning electric field generated by the cleaning potential is obtained as in the case where shield electrode 39 is grounded, and satisfactory cleaning is possible.

Though a rectangular wave is supplied as the cleaning potential in the above described embodiment, the waveform is not limited thereto, and various potential waveforms including various oscillation components, such as triangular wave or sinusoidal wave may be used.

It is most effective, however, when the rectangular wave such as used in the above described embodiment or a potential waveform causing an extremely large change in the direction of electric field such as in the case of an impulse train consisting of impulses of mutually opposite polarities, is used. At the transition where change in the electric field is attained in a moment, which is characteristic of such waveform, the same effect as attained when oscillation is applied in extremely wide frequency range is attained. Accordingly, the effect of cleaning is further enhanced.

In the above described embodiment, shield electrode 39 is arranged on that side of control electrode 26 which faces opposing electrode 25. However, the structure of the control electrode is not limited thereto. Shield electrode 39 may be arranged on the side of toner carrier 22, or shield electrodes 39 may be arranged on the side facing toner carrier 22 and on the side facing opposing electrode 25, respectively. Satisfactory cleaning operation is also possible when such a structure is employed.

Figure 17:
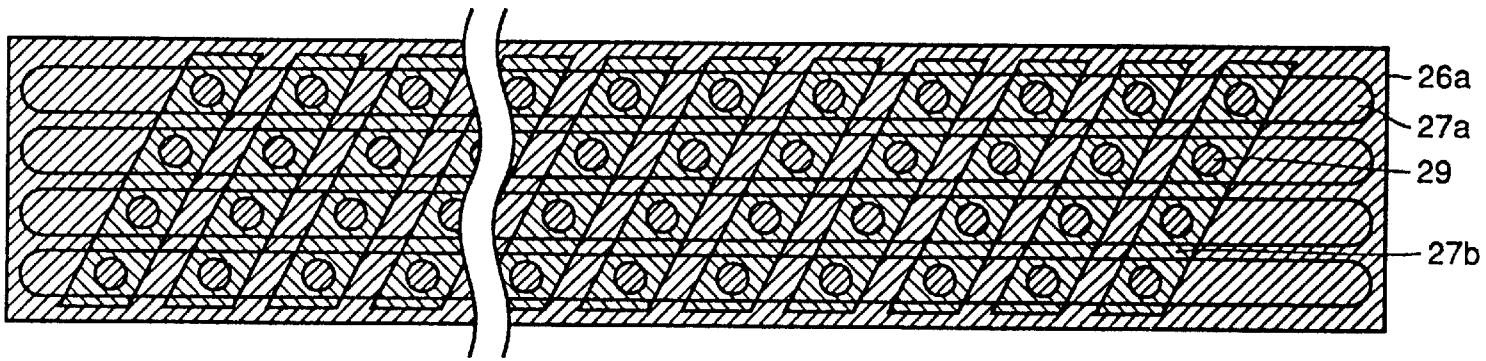
FIG. 17 is a plan view showing a control electrode in accordance with another embodiment of the image forming apparatus in accordance with the present invention.

In the above described embodiment, jetting of toner 21 through gate 29 has been described, taking control electrode 26 of single drive type, in which jetting of toner is controlled by one electrode for each gate 29, as an example. The present invention is similarly applicable to a control electrode 26 utilizing matrix control such as shown in FIG. 17, enabling good image formation. In the example of FIG. 17, strip electrodes 27*a* and 27*b* are arranged in place of ring-shaped electrodes 27.

Strip electrode 27*b* is arranged on that side of control electrode 26 which faces toner carrier 22, and strip electrode 27*a* is arranged on that side which faces opposing electrode 25. In the control electrode 26 shown in FIG. 17, the number of FETs (Field Effect Transistors), not shown, as means for switching potential of each gate 29 can be reduced significantly. When compared with control electrode 26 shown in FIG. 3, for example, the necessary number of FETs in control electrode 26 of FIG. 17 can be reduced to about ¼. In view of reduction in number of FETs used, the control electrode 26 such as shown in FIG. 17 is very effective.

Though the cleaning operation described above is performed between paper feeding during continuous printing, the timing of cleaning is not limited thereto. For example, the cleaning operation may desirably be performed at the timing before the start of printing, after the end of printing, after power on, or after a paper jamming is removed.

Further, oscillation or duty factor of the potential used for cleaning are not limited to those described above. The oscillation or duty factor cannot be uniquely determined, and it should be adjusted appropriately to ensure satisfactory cleaning in accordance with the characteristics of toner 21 used and of dielectric layer arranged on the surface of opposing electrode 25.

Though a black and white image forming apparatus has been described as an example in the foregoing, the present invention is well applicable to a color image forming apparatus.

Figure 18:
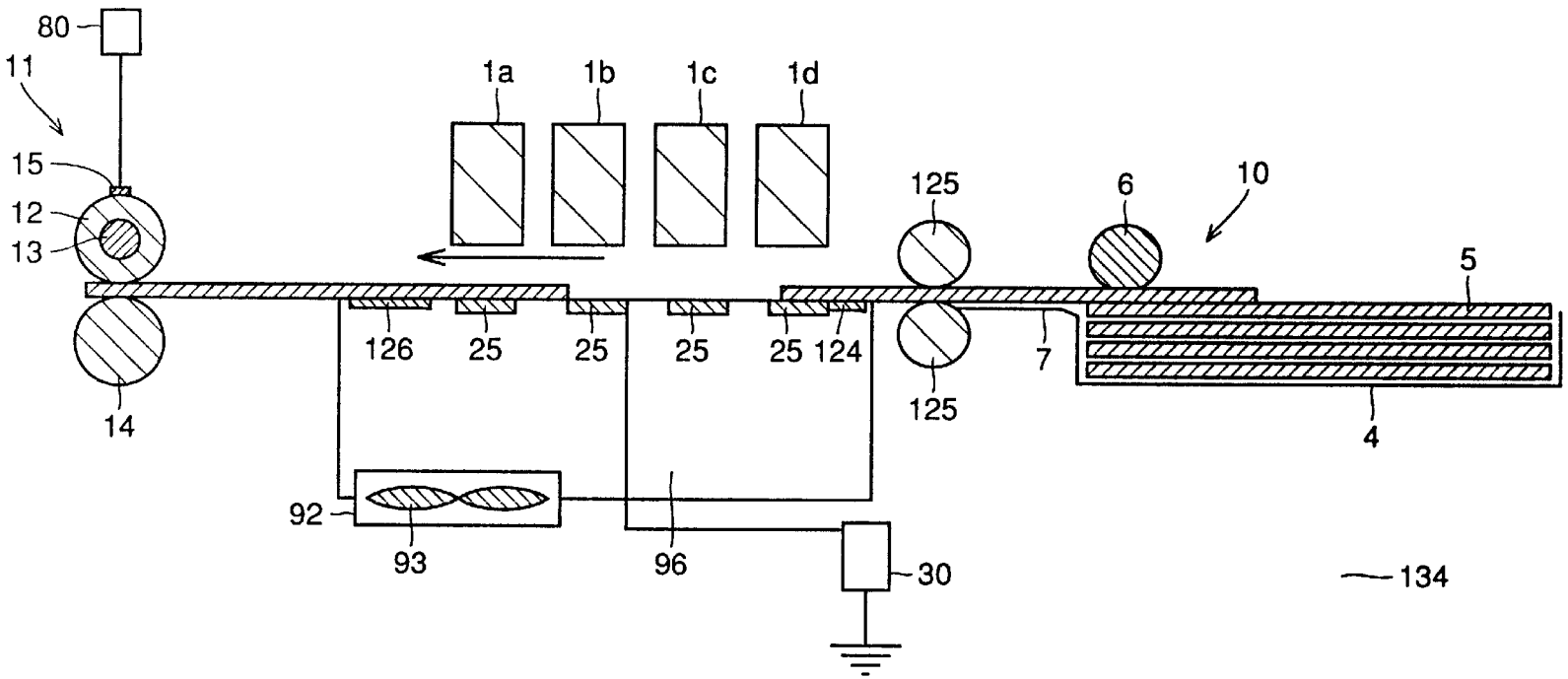
FIG. 18 is a cross section showing a color image forming apparatus employing the image forming apparatus of the present invention.

The color image forming apparatus may include, as shown in FIG. 18, a plurality of image forming units each having a toner supply unit and a printing unit. A color image forming apparatus using color toners, for example, yellow, magenta, cyan and black toners at respective toner supply units may be formed. In the example of FIG. 18, image forming units 1*a*, 1*b*, 1*c* and 1*d* corresponding to yellow, magenta, cyan and black, respectively, and implementing the present invention are arranged, and color image formation is performed based on color image data. Other components may be the same as those shown in FIG. 2.

As to the cleaning operation which takes place in each of the image forming units 1 of FIG. 18, there may be a case where more than one cleaning electric field is necessary as toner 21 used have mutually different characteristics. In that case, it is desired that cleaning is performed using optimal cleaning potential for cleaning each toner 21, in accordance with the characteristic of toner 21 used in each image forming unit 1.

However, in such a case, the number of used power sources may be increased, leading to increased number of parts, increased size and cost, and lower reliability. In that case, it is most preferable to apply a single cleaning potential which is sufficient to enable cleaning of each of the control electrodes 26.

From the foregoing, the condition for satisfactory cleaning is $Fc<FE<Fb$ where Fc represents attracting force attracting toner 21 to control electrode 26, Fb represents attracting force attracting toner 21 to opposing electrode 25 and FE represents electric force received by toner 21 from cleaning electric field. However, it is readily expected that when a cleaning potential necessary in image forming unit l*a* is applied in image forming unit 1*b*, an electric force FEb applied to toner 21 is in a relation FEb<Fc<Fb. In this case, cleaning of control electrode 26 is not possible in image forming unit 1*b*. In that case, it is reasonable to adjust dielectric constant and thickness of protective layer 26*c* arranged on control electrode 26 and of the dielectric layer arranged on the surface of opposing electrode 25 and further, to adjust the amount of charges of toner 21 used, so as to enable satisfactory cleaning.

Though toner has been described as an example of the developer in the embodiment above, the developer may be an ink or the like. Further, a structure utilizing ion flow method may be adopted in the toner supply unit. In other words, the image forming unit may have an ion source such as a corona charger. In this case also, similar function and effects as described above can be obtained.

The image forming apparatus in accordance with the present invention is suitably applicable to the printing unit of a digital copying machine and a facsimile, as well as a digital printer, plotter and the like.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image forming apparatus, comprising:

carrier means for carrying a developer;

an opposing electrode arranged opposing to said carrier means;

power supply means for supplying a voltage to generate a potential difference between said carrier means and said opposing electrode;

a control electrode including a plurality of electrodes, arranged between said carrier means and said opposing electrode; and control means for implementing a plurality of potential states to each of the electrodes of said control electrode; wherein said control electrode includes an insulating substrate, a plurality of said electrodes provided on said insulating substrate and each having a passage portion for said developer, and a dielectric layer formed on a side facing said opposing electrode to ensure that an attracting force Fc attracting said developer adhered on that side of said control electrode which faces said opposing electrode is smaller than an attracting force Fb attracting said developer adhered on said opposing electrode; and said control means includes image forming means for applying a prescribed potential to each of said plurality of electrodes, controlling passage of said developer through said passage portion, and for forming an image on a surface of a recording medium conveyed on said opposing electrode, and electric field applying means for applying an electric field of which electric field direction changes between said opposing electrode and said control electrode, and which ensures that an electric force FE received by said developer adhered on said control electrode is greater than said attracting force Fc and that said electric force FE is smaller than said attracting force Fb.

2. The image forming apparatus according to claim 1, wherein said electric field applying means includes rectangular wave potential applying means for applying a rectangular wave potential to provide an electric field which ensures that said electric force FE received by said developer adhered on said control electrode is greater than said attracting force Fc and that said electric force FE is smaller than said attracting force Fb.

3. The image forming apparatus according to claim 2, wherein said rectangular wave potential applying means includes means for applying a rectangular wave potential to provide an electric field, the potential waveform including an oscillation component, and ensures that said electric force FE received by said developer adhered on said control electrode is greater than said attracting force Fc, and that said electric force is smaller than said attracting force Fb.

4. The image forming apparatus according to claim 1, wherein said electric field applying means includes triangular wave potential applying means for applying a triangular wave potential to provide an electric field which ensures that said electric force FE received by said developer adhered on said control electrode is greater than said attracting force Fc and that said electric force FE is smaller than said attracting force Fb.

5. The image forming apparatus according to claim 1, wherein said electric field applying means includes sinusoidal wave potential applying means for applying a sinusoidal wave potential to provide an electric field which ensures that said electric force FE received by said developer adhered on said control electrode is greater than said attracting force Fc and that said electric force FE is smaller than said attracting force Fb.

6. The image forming apparatus according to claim 1, wherein said electric field applying means includes means for applying an electric field having an oscillation component, of which electric field direction changes between said opposing electrode and said control electrode, and which ensures that the electric force FE received by said developer adhered on said control electrode is greater than said attracting force Fc, and that said electric force is smaller than said attracting force Fb.

7. The image forming apparatus according to claim 1, wherein said developer, said carrier means, said opposing electrode and said control electrode include a plurality of developers, a plurality of said carrier means, a plurality of opposing electrodes and a plurality of control electrodes, respectively, and said electric field applying means includes means for applying a plurality of electric fields of which electric field directions changed between said plurality of opposing electrodes and said plurality of control electrodes in accordance with respective characteristics of said plurality of developers, and which ensures that a plurality of electric forces FFE received by said plurality of different developers adhered on said plurality of control electrodes respectively are greater than attracting forces FFc of said plurality of different developers adhered on that surfaces of said plurality of control electrodes which face said opposing electrodes, respectively, and that said plurality of electric forces FFE are smaller than attracting forces FFb of said plurality of developers adhered on said plurality of opposing electrodes, respectively.

8. The image forming apparatus according to claim 1, wherein said developer, said carrier means, said opposing electrode and said control electrode include a plurality of developers, a plurality of said carrier means, a plurality of opposing electrodes and a plurality of control electrodes, respectively, said electric field applying means includes means for applying a single electric field satisfying a prescribed condition, a dielectric layer of each of said plurality of control electrodes include a dielectric layer having a dielectric constant or thickness adjusted to satisfy said prescribed condition when said electric field applying means applies said single electric field, each of said plurality of developers includes a developer having amount of charges adjusted to satisfy said prescribed condition when said electric field applying means applies said single electric field, and said prescribed condition is that direction of electric field changes between said plurality of opposing electrodes and said plurality of control electrodes, a plurality of electric forces FFE received by said plurality of developers adhered on said plurality of control electrodes are greater than attracting forces FFc of said plurality of developers adhered on that side of said plurality of control electrodes which faces said opposing electrodes, respectively, and that said plurality of electric forces FFE are smaller than attracting forces FFb of said plurality of developers adhered on said plurality of opposing electrodes, respectively.

9. The image forming apparatus according to claim 1, further comprising cleaning means for removing said developer adhered on a surface of said opposing electrode.

* * * * *